US007559978B2

(12) United States Patent
Soloveichik et al.

(10) Patent No.: US 7,559,978 B2
(45) Date of Patent: Jul. 14, 2009

(54) GAS-LIQUID SEPARATOR AND METHOD OF OPERATION

(75) Inventors: Grigorii Lev Soloveichik, Latham, NY (US); David Brandon Whitt, Albany, NY (US)

(73) Assignee: General Electric Company, Niskayuna, NY (US)

( * ) Notice: Subject to any disclaimer, the term of this patent is extended or adjusted under 35 U.S.C. 154(b) by 480 days.

(21) Appl. No.: 11/229,984

(22) Filed: Sep. 19, 2005

(65) Prior Publication Data

US 2007/0234900 A1 Oct. 11, 2007

(51) Int. Cl.
*B01D 19/00* (2006.01)

(52) U.S. Cl. ..... 95/241; 95/260; 95/262; 96/155; 96/204; 96/219; 55/319; 204/237; 204/266

(58) Field of Classification Search ..... 95/241, 95/260, 262; 96/155, 204, 219; 55/319; 204/237, 266
See application file for complete search history.

(56) References Cited

U.S. PATENT DOCUMENTS 2,739,936 A * 3/1956 Zdansky ..... 204/256
3,410,770 A * 11/1968 Buechler ..... 205/628
4,950,371 A * 8/1990 McElroy ..... 205/628
5,316,643 A * 5/1994 Ahn et al. ..... 204/265
5,665,211 A * 9/1997 Leppanen et al. ..... 204/237
5,667,647 A * 9/1997 Suga et al. ..... 204/237
5,690,797 A * 11/1997 Harada et al. ..... 204/228.5
5,783,051 A 7/1998 Hirai et al. ..... 204/254
5,796,799 A * 8/1998 Kobayashi et al. ..... 376/306
6,787,258 B2 * 9/2004 Prerad ..... 429/21
7,381,313 B2 * 6/2008 Libby et al. ..... 204/239
2005/0000800 A1 1/2005 Speranza et al. ..... 204/258

OTHER PUBLICATIONS

J. N. Murray, "Advanced Alkaline Electrolysis Cell Development Final Report Development of Electrolysis Cell Separator for 125o C Operation," Teledyne Energy Systems, Mar. 1983, 141 pages.

* cited by examiner

*Primary Examiner*—Duane Smith
*Assistant Examiner*—Douglas J Theisen
(74) *Attorney, Agent, or Firm*—Scott J. Amus

(57) ABSTRACT

A system for gas-liquid separation in electrolysis processes is provided. The system includes a first compartment having a liquid carrier including a first gas therein and a second compartment having the liquid carrier including a second gas therein. The system also includes a gas-liquid separator fluidically coupled to the first and second compartments for separating the liquid carrier from the first and second gases.

34 Claims, 3 Drawing Sheets

GAS-LIQUID SEPARATOR AND METHOD OF OPERATION

STATEMENT REGARDING FEDERALLY SPONSORED RESEARCH & DEVELOPMENT

This invention was made with Government support under contract number DE-FC36-04GO14223 awarded by the U.S. Department of Energy. The Government has certain rights in the invention.

BACKGROUND

The invention relates generally to gas-liquid separators, and more particularly, to a gas-liquid separator for an alkaline electrolyzer.

Various types of hydrogen production systems have been designed and are in use. For example, electrolyzer systems generate hydrogen through electrolysis of water. The hydrogen acts as an energy carrier, and can be converted back to electricity for power generation or distributed for use as a fuel. Typically, hydrogen generated from such systems is purified and compressed for storage before it is consumed in an end use system. For example, the end use system may be of a business or industrial nature where the stored hydrogen is used for power generation through hydrogen-powered internal combustion engines, fuel cells, and turbines. Moreover, the stored hydrogen may be distributed to a consumer for powering a vehicle or for use in certain residential applications such as cooking, and so forth.

In certain systems, an alkaline electrolyzer is used for hydrogen generation. Typically, an alkaline electrolyzer uses a liquid alkaline electrolyte such as aqueous potassium hydroxide or sodium hydroxide to facilitate electrolysis of water for generation of hydrogen and oxygen. Further, hydrogen and oxygen are produced in cathodic and anodic compartments respectively of the alkaline electrolyzer. In addition, hydrogen-electrolyte mixture and oxygen-electrolyte mixture from the cathodic and anodic compartments are directed to individual gas-liquid separators for separating the hydrogen and oxygen from the electrolyte.

In operation, the rate of production of hydrogen in the cathodic compartment is different than that of oxygen in the anodic compartment, thereby resulting in variations of the electrolyte level in the individual gas-liquid separators. It is desirable to monitor and control the electrolyte level in the gas-liquid separators to avoid a situation where gas is drawn into the electrolyzer, producing an explosive hydrogen-oxygen mixture. In certain systems, the electrolyte level is monitored using sensors in the gas-liquid separators. Further, the electrolyte level may be controlled via tubes and appropriate valving to achieve the desired electrolyte level in each of the gas-liquid separators. Incorporation of functionalities to monitor and control the electrolyte level is a challenge due to costs and functionality issues. Moreover, a temperature gradient between the two separators may also result due to the varying level of the electrolyte in the respective gas-liquid separators. As a result, the thermal management of the gas-liquid separators may be a challenge in such systems.

Accordingly, there is a need for a gas-liquid separator that provides the separation of gas and liquid in a system by employing a relatively simple and cost effective technique. It would also be advantageous to provide a gas-liquid separator for an alkaline electrolyzer that will separate the hydrogen and oxygen generated in the electrolyzer from the electrolyte, while preventing the formation of explosive hydrogen-oxygen mixture.

BRIEF DESCRIPTION

Briefly, according to one embodiment a system is provided. The system includes a first compartment having a liquid carrier including a first gas therein and a second compartment having the liquid carrier including a second gas therein. The system also includes a gas-liquid separator fluidically coupled to the first and second compartments for separating the liquid carrier from the first and second gases.

In another embodiment, a gas-liquid separator is provided. The gas-liquid separator includes a first chamber configured to receive a liquid carrier including a first gas therein and to separate the first gas from the liquid carrier and a second chamber configured to receive the liquid carrier including a second gas therein and to separate the second gas from the liquid carrier. The gas-liquid separator also includes a partition disposed between the first and second chambers to provide liquid communication between the first and second chambers.

In another embodiment, a method of separating hydrogen and oxygen from an electrolyte in an electrolyzer is provided. The method includes supplying a hydrogen-electrolyte mixture from the electrolyzer to a first chamber of a gas-liquid separator and supplying an oxygen-electrolyte mixture from the electrolyzer to a second chamber of a gas-liquid separator. The method also includes separating hydrogen and the electrolyte from the hydrogen-electrolyte mixture via the first chamber of a gas-liquid separator and separating oxygen and the electrolyte from the oxygen-electrolyte mixture via the second chamber of the gas-liquid separator. Further, the method includes regulating a level of the electrolyte in the first and second chambers by maintaining a liquid communication between the first and second chambers of the gas-liquid separator and releasing the separated hydrogen and oxygen from the first and second chambers of the gas-liquid separator.

DRAWINGS

These and other features, aspects, and advantages of the present invention will become better understood when the following detailed description is read with reference to the accompanying drawings in which like characters represent like parts throughout the drawings, wherein.

DETAILED DESCRIPTION

Figure 1:
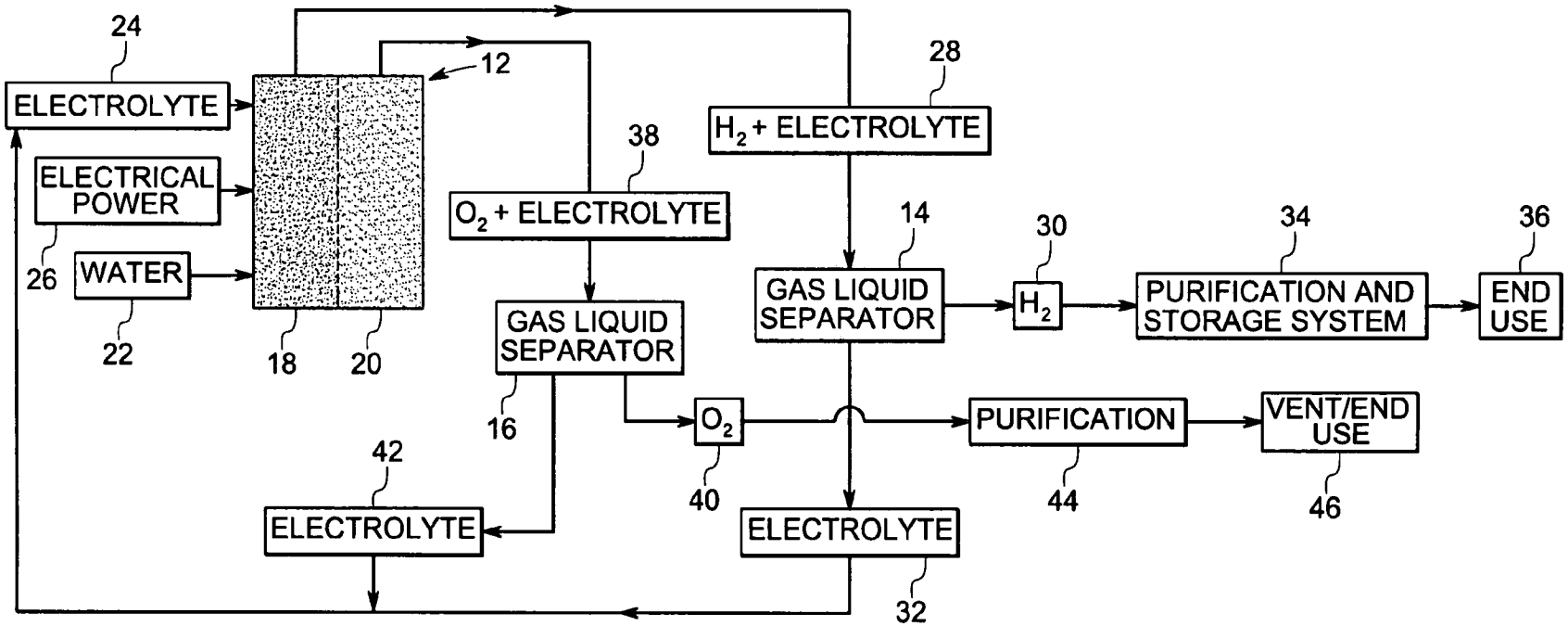
FIG. 1 PRIOR ART
FIG. 1 is a diagrammatical representation of a conventional alkaline electrolyzer with two individual gas-liquid separators for separating hydrogen and oxygen from the electrolyte.

As discussed in detail below, embodiments of the present technique function to provide a gas-liquid separator for separating gases from a liquid carrier. Although the present discussion focuses on a gas-liquid separator for an electrolyzer, the present technique is not limited to electrolyzers. Rather, the present technique is applicable to any number of suitable fields in which separation of gases from a gas-liquid mixture is desired. Turning now to drawings and referring first to FIG. 1 a hydrogen production and processing system 10 having a hydrogen production system 12 for production of hydrogen from water is illustrated. In the illustrated embodiment, the hydrogen production system includes gas-liquid separators 14 and 16 for separating hydrogen and oxygen from hydrogen-electrolyte and oxygen-electrolyte mixtures produced by the system 12. Such a system 10 is known in the art.

In the illustrated embodiment, the hydrogen production and processing system 10 includes an electrolyzer 12, for hydrogen production. In operation, the electrolyzer 12 generates hydrogen from electrolysis of water via an electrolyzer such as, but not limited to, an alkaline electrolyzer and a polymer electrolyte membrane (PEM) electrolyzer. In the illustrated embodiment, the hydrogen production system 12 includes an alkaline electrolyzer that uses a liquid alkaline electrolyte such as potassium hydroxide or sodium hydroxide to facilitate electrolysis of water.

The electrolyzer 12 includes a cathode compartment 18 and an anode compartment 20. In the illustrated embodiment, hydrogen is generated in the cathode compartment 18 and oxygen is generated in the anode compartment 20. In operation, the electrolyzer 12 receives a supply of water 22. In certain embodiments, the water 22 may be de-ionized before it is supplied to the electrolyzer 12. In this embodiment, the water 22 is directed to a deionizer before entering the electrolyzer 12. Further, the water 22 may be added to an existing electrolyte solution 24 intermittently or continuously to replace the water 22 that has been consumed. Examples of electrolyte 24 include an alkaline solution, such as potassium hydroxide or sodium hydroxide. In one embodiment, the electrolyte 24 includes a polymer electrolyte membrane (PEM) where the gas-liquid separators 14 and 16 are configured to separate hydrogen and oxygen from hydrogen-water and oxygen-water mixtures respectively. However, other types of electrolytes may also be used.

Moreover, the electrolyzer 12 receives electrical power 26 from a power bus (not shown). The electrical power 26 from the power bus may be directed to a rectifier that is configured to convert alternating current (AC) from the power bus to direct current (DC) at a desired voltage and current for the operation of the electrolyzer 12. The electrolyzer 12 uses the electrical power 26 to split the de-ionized water for generation of hydrogen and oxygen. In the illustrated embodiment, a hydrogen-electrolyte mixture 28 is produced in the cathode compartment 18 of the electrolyzer 12. Moreover, the hydrogen-electrolyte mixture 28 is supplied to the gas-liquid separator 14 that is coupled to the cathode compartment 18 of the electrolyzer. In the illustrated embodiment, the gas-liquid separator 14 separates the hydrogen-electrolyte mixture 28 into hydrogen 30 and electrolyte 32. The electrolyte 32 is typically recycled to the electrolyzer 12. Further, hydrogen 30 may be directed to a purification and storage system 34 for purification and storage. In one embodiment, the produced hydrogen 30 may be compressed for storage via a compressor (not shown). Subsequently, the stored hydrogen 30 may be dispensed as a product. Alternatively, the stored hydrogen 30 may be utilized by an end use system 36. For example, the stored hydrogen 30 may be utilized as a fuel for a gas turbine of a power generation system.

Further, an oxygen-electrolyte mixture 38 is produced in the anode compartment 20 of the electrolyzer 12. The oxygen-electrolyte mixture 38 is supplied to the second gas-liquid separator 16 that is coupled to the anode compartment 20 of the electrolyzer 12. Subsequently, the gas-liquid separator 16 separates the oxygen-electrolyte mixture 38 into oxygen 40 and electrolyte 42. Again, the electrolyte 42 is typically recycled to the electrolyzer 12. Further, oxygen 40 may be directed to a purification and storage system 44 for purification and storage. The oxygen 40 generated from the electrolyzer 12 may be vented into the atmosphere or stored in an oxygen storage vessel (not shown) and may be utilized for any suitable purpose, as represented by reference numeral 46. In certain embodiments, the generated oxygen may be compressed by a compressor (not shown) and stored in the oxygen storage vessel.

In the illustrated embodiment, the system 10 includes two separate gas-liquid separators 14 and 16 coupled to the cathode and anode compartments 18 and 20 respectively. As will be appreciated by one skilled in the art the rate of production of hydrogen 30 in the cathode compartment 18 may be different than the rate of production of oxygen 40 in the anode compartment 20. In one embodiment, the rate of production of hydrogen 30 is about twice the rate of production of oxygen 40. As a result, the level of electrolyte in the gas-liquid separator 14 will be different than the level of the electrolyte in the gas-liquid separator 16. In certain embodiments, sensors (not shown) may be employed to monitor the level of the electrolyte in the first and second gas-liquid separators 14 and 16. Further, the level of electrolyte in the first and second gas-liquid separators 14 and 16 may be controlled via tubes and required valving to avoid production of an explosive hydrogen-oxygen mixture in the system 10. Such disadvantages of the system 10 may be overcome by having a single gas-liquid separator for separation of hydrogen and oxygen as described below with reference to FIG. 2.

Figure 2:
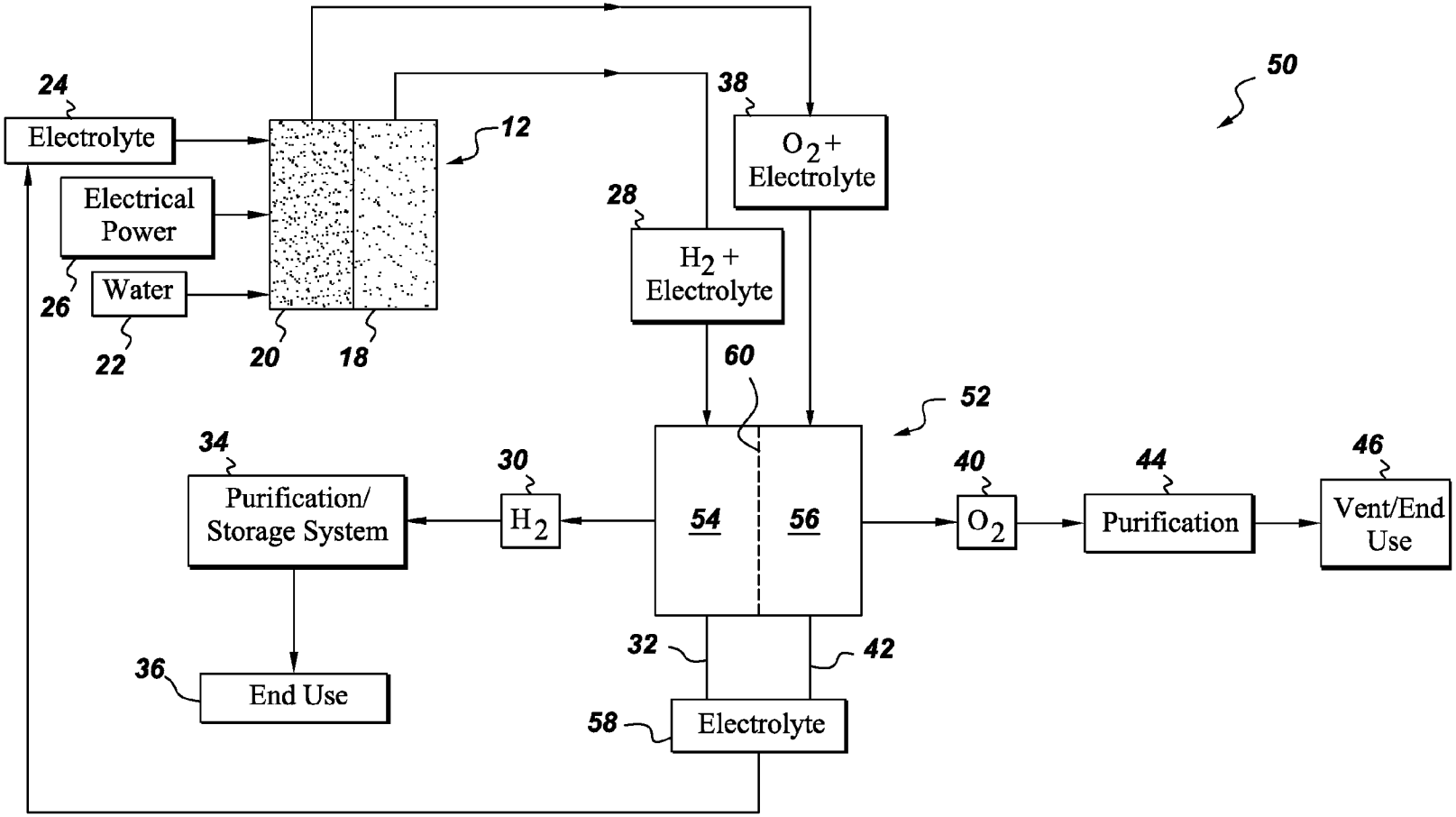
FIG. 2 is a diagrammatical representation of an alkaline electrolyzer with a gas-liquid separator for separating hydrogen and oxygen from the electrolyte, in accordance with embodiments of the present technique.

FIG. 2 is a diagrammatical representation of a hydrogen production system 50 with a gas-liquid separator 52 for separating hydrogen and oxygen from the electrolyte. In an exemplary configuration, the gas-liquid separator 52 is fluidically coupled to the cathode and anode compartments 18 and 20 of the electrolyzer 12. Further, the gas-liquid separator 52 includes a first chamber 54 configured to receive the hydrogen-electrolyte mixture 28 from the cathode compartment 18 of the electrolyzer 12. In addition, the gas-liquid separator 52 includes a second chamber 56 configured to receive the oxygen-electrolyte mixture 38 from the anode compartment 20 of the electrolyzer 12. In this embodiment, the system 50 includes a first inlet (not shown) to supply the hydrogen-electrolyte mixture 28 to the first chamber 54. Similarly, system 50 includes a second inlet (not shown) to supply the oxygen-electrolyte mixture 38 to the second chamber 56.

In the illustrated embodiment, the first chamber 54 is configured to separate hydrogen 30 and the electrolyte 32 from the hydrogen-electrolyte mixture 28. Similarly, the second chamber 56 is configured to separate oxygen 40 and the electrolyte 42 from the oxygen-electrolyte mixture 38. The system 50 includes first and second outlets (not shown) for releasing the hydrogen 30 and oxygen 40 from the first and second chambers 54 and 56. Further, electrolyte 58 collected from the first and second chambers 54 and 56 is recycled to the electrolyzer 12. In a present embodiment, a liquid outlet may be employed to collect the electrolyte 58 from the first and second chambers 54 and 56. In one embodiment, the liquid outlet includes a tee shaped outlet.

Figure 4:
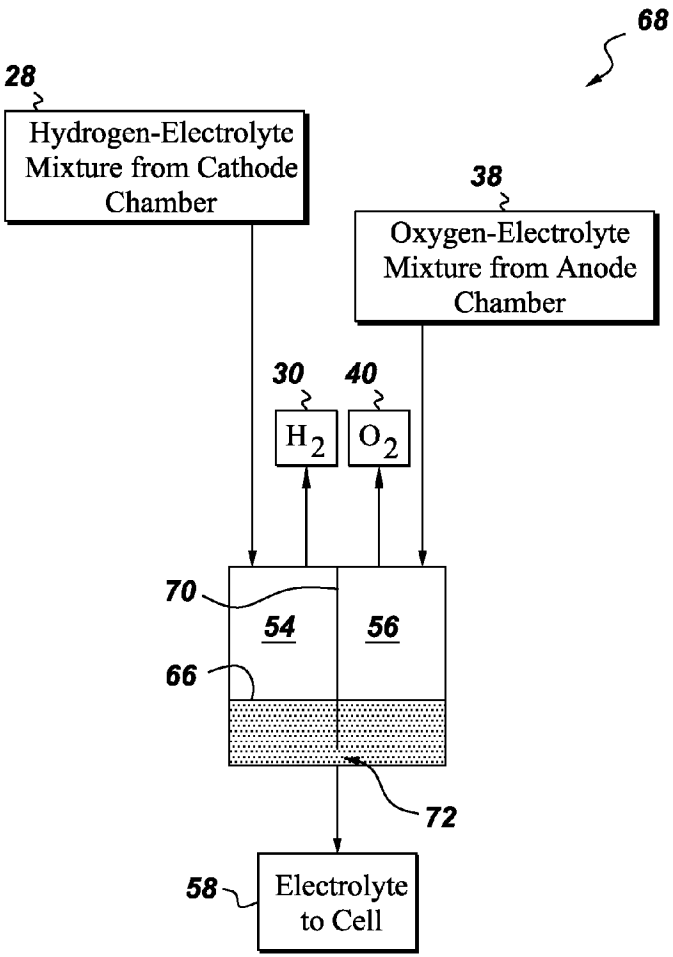
FIG. 4 is a diagrammatical representation of a gas-liquid separator for the alkaline electrolyzer of FIG. 2, in accordance with another exemplary embodiment of the present technique.
Figure 3:
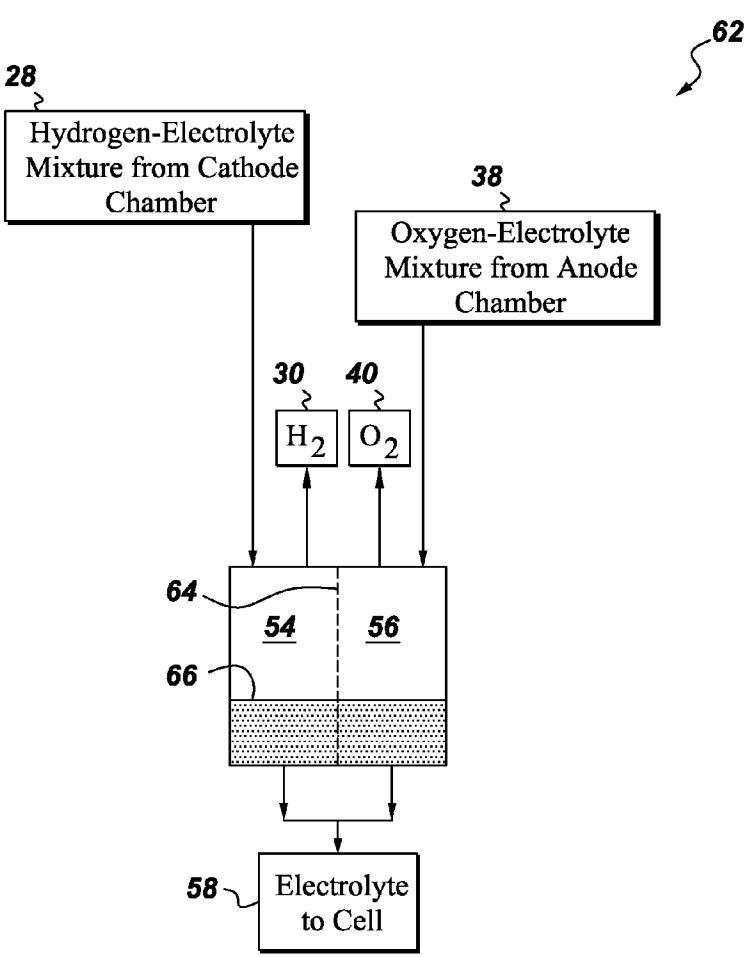
FIG. 3 is a diagrammatical representation of a gas-liquid separator for the alkaline electrolyzer of FIG. 2, in accordance with an exemplary embodiment of the present technique.

In the illustrated embodiment, the second chamber 56 of the gas-liquid separator 52 is in liquid communication with the first chamber 54 via a partition 60 between the first and second chambers 54 and 56. FIGS. 3 and 4 illustrate exemplary configurations of the gas-liquid separator 52 employed in the system 50.

FIG. 3 illustrates a gas-liquid separator 62 for the system of FIG. 2, in accordance with an exemplary embodiment of the present technique. In a presently contemplated configuration, a liquid permeable diaphragm 64 is disposed between the first and second chambers 54 and 56. The liquid permeable diaphragm 64 is configured to provide a liquid communication between the first and second chambers 54 and 56. In the illustrated embodiment, the liquid permeable diaphragm 64 facilitates the regulation of electrolyte level 66 in the first and second chambers 54 and 56. It should be noted that the pore size of the liquid permeable diaphragm 64 is selected to substantially prevent gas diffusion between the first and second chambers 54 and 56. Examples of liquid permeable diaphragm 64 include a porous material made of natural or synthetic asbestos, polysulfone, polyethersulfone, polyphenyleneoxide, polyphenylenesulfide, polyolefine, polystyrene, fluorpolymer and combinations thereof having pore size less than size of gas bubbles and preventing gas permeability.

In operation, the first chamber 54 receives the hydrogen-electrolyte mixture 28 from the cathode chamber 18 (see FIG. 2) via an inlet. The first chamber 54 separates hydrogen 30 from the hydrogen-electrolyte mixture 28, which is released via an outlet. Similarly, the second chamber 56 receives the oxygen-electrolyte mixture 38 from the anode chamber 20 (see FIG. 2) via an inlet. The second chamber 56 separates oxygen 40 from the oxygen-electrolyte mixture 38, which is released via an outlet. Further, the electrolyte 58 from the first and second chambers 54 and 56 are collected via the liquid outlet and are typically recycled to the electrolyzer 12. Because the membrane 64 is liquid permeable, the electrolyte solution 58 mixes and comes to an equilibrium state at the outlet of the separator 62, while the hydrogen 30 and oxygen 40 are separated in accordance with existing techniques. For example, in the illustrated embodiment, the gravitational forces control the gas-liquid separation in the gas-liquid separator 62. In certain embodiments, a coalescer device may be employed to facilitate the gas-liquid separation. As discussed above, having a single electrolyte solution mixture 58 being recirculated into the system will help prevent mixing of hydrogen 30 and oxygen 40 in the system and will assist in equilibrating the temperature of the electrolyte 58.

In certain embodiments, the gas-liquid separator 62 may include nitrogen purge inlets (not shown) coupled to the first and second chambers 54 and 56 to facilitate nitrogen purge in the first and second chambers 54 and 56 during a start-up, or a shut-down condition of the electrolyzer 12. Further, each of the first and second chambers 54 and 56 of the gas-liquid separator 62 may also include a coalescer device to facilitate bubble coalescence and the gas-liquid separation in the first and second chambers 54 and 56. In one embodiment, the coalescer device includes a baffle. In an alternate embodiment, the coalescer device includes a screen. However, other types of coalescer devices are envisioned. It should be noted that the coalescer device is disposed above the level of the electrolyte in the first and second chambers 54 and 56.

FIG. 4 illustrates another gas-liquid separator 68 for the system of FIG. 2, in accordance with an exemplary embodiment of the present technique. In the illustrated embodiment, the gas-liquid separator 68 includes a solid partition 70 disposed between the first and second chambers 54 and 56. Further, the solid partition 70 includes an opening 72 proximate a bottom portion of the first and second chambers 54 and 56 adjacent the outlet of the gas-liquid separator 68. In the illustrated embodiment, the opening 72 facilitates the liquid communication between the first and second chambers 54 and 56 to regulate the electrolyte level in the first and second chambers 54 and 56.

In operation, the first and second chambers 54 and 56 receive hydrogen-electrolyte and oxygen-electrolyte mixtures 28 and 38 via inlets. The first chamber 54 separates hydrogen 30 from the hydrogen-electrolyte mixture 28. Further, the second chamber 56 separates oxygen 40 from the oxygen-electrolyte mixture 38. As described before, nitrogen purge inlets may be coupled to the first and second chambers 54 and 56 to facilitate nitrogen purge in the first and second chambers 54 and 56 during a start-up, or a shut-down condition of the electrolyzer 12. Further, each of the first and second chambers 54 and 56 of the gas-liquid separator 62 may also include a coalescer device to facilitate bubble coalescence and the gas-liquid separation in the first and second chambers 54 and 56.

The following examples illustrate a comparison of functioning of exemplary gas-liquid separators employed in the hydrogen production systems of FIGS. 1 and 2. It should be noted that, these examples are only meant to be a rough comparison for the exemplary gas-liquid separators and are not meant to confine the scope of the present invention.

EXAMPLE 1

In an exemplary alkaline electrolyzer having a Raney Nickel cathode and a stainless steel anode the working electrode surface area is about 8.8 $cm^2$. The electrolysis cell of the electrolyzer is used as a divided cell with a porous diaphragm made of polyethersulfone. The electrolyte used for the electrolysis is placed in glass storage vessels. In this exemplary embodiment, the electrolyte includes 2 L of 30 wt. % KOH. Further, the glass storage vessels also function as gas-liquid separators. The glass storage vessels include a liquid inlet at the top of each vessel and a liquid outlet at the bottom. Further, each of the glass storage vessels also includes a condenser with a gas outlet. The electrolyte is recirculated through the electrolysis cell by using a MasterFlex L/S peristaltic pump with a rate of 125 mL/min. In the exemplary system all hoses and connectors employed in the system are made of polytetrafluoroethylene (PTFE). The electrolyte temperature in the electrolysis cell is maintained at 80° C. by using a heating tape with a regulator. In the exemplary system a power source Sorensen DCS40-13E is employed for providing the electrical power for electrolysis at a rate of about 250 $mA/cm^2$.

In an exemplary experiment performed with the system described above the electrolyte is placed into two glass vessels. The electrolyte is heated to a working temperature and electric current is passed through the electrolysis cell to produce hydrogen and oxygen. The hydrogen and oxygen are separated from the electrolyte in the glass vessels. During operation, the level of electrolyte in the two vessels is monitored and is observed to be substantially different over a period of time. Therefore, the level of electrolyte had to be manually adjusted via clamps. Moreover, the content of hydrogen and oxygen in the vessels are monitored by gas chromatography (GC) and are measured within a steady regime. In the current situation, due to solubility of oxygen in the electrolyte and relatively less efficient gas-liquid separation the concentration of the hydrogen is about 1.15%.

EXAMPLE 2

In another exemplary system, the electrolyte is placed into a single vessel having two compartments that are being employed as gas-liquid separators. It should be noted that the gas-liquid separator/vessel have a similar shape as that of the gas-liquid separators employed in the system of Example 1. In a present system the two compartments are separated via a glass plate welded to the vessel walls. Further, the electrolysis is carried on in a similar manner as in the system of Example 1. In the illustrated embodiment, the electrolyte in the two compartments is observed to be at a substantially similar level and therefore did not require any adjustment. Moreover, the concentration of oxygen and hydrogen measured at a steady regime is about 1.33% that is statistically about the same level of gas-liquid separation as of the system of Example 1. Thus, employing a single gas-liquid separator having two compartments facilitates a substantially efficient gas-liquid separation while self-regulating the electrolyte level in the two compartments of the gas-liquid separator.

The various aspects of the method described hereinabove have utility in hydrogen production systems used for different applications. As noted above, the gas-liquid separator described above provides the separation of gas and liquid in a hydrogen production system such as, an alkaline electrolyzer to separate the hydrogen and oxygen generated in the electrolyzer from the electrolyte. Further, the gas-liquid separator also substantially prevents the formation of explosive hydrogen-oxygen mixture due to diffusion of the gases by self-regulating the level of electrolyte in the two compartments of the gas-liquid separator. Advantageously, the self-regulating feature of the gas-liquid separator facilitates the separation of the gases from the electrolyte without the need of monitoring and controlling the level of the electrolyte in the gas-liquid separator. Further, having a single electrolyte mixture being recirculated into the system assists in equilibrating the temperature of the electrolyte thereby facilitating the thermal management of the gas-liquid separator.

While only certain features of the invention have been illustrated and described herein, many modifications and changes will occur to those skilled in the art. It is, therefore, to be understood that the appended claims are intended to cover all such modifications and changes as fall within the true spirit of the invention.

The invention claimed is:

1. A system, comprising:

a first compartment having a liquid carrier including a first gas therein;

a second compartment having the liquid carrier including a second gas therein; and a gas-liquid separator fluidically coupled to the first and the second compartments for separating the liquid carrier from the first and second gases;

wherein the gas-liquid separator comprises a first chamber configured to receive the liquid carrier including the first gas from the first compartment and a second chamber configured to receive the liquid carrier including the second gas from the second compartment, and wherein the second chamber is in liquid communication with the first chamber via a partition between the first and second chambers.

2. The system of claim 1, wherein the system comprises an alkaline electrolyzer and the first and second compartments comprise cathode and anode compartments of the electrolyzer.

3. The system of claim 2, wherein the liquid carrier comprises an electrolyte and the first and second gases comprise hydrogen and oxygen.

4. The system of claim 1, wherein the first chamber is configured to separate the first gas from the liquid carrier and the second chamber is configured to separate the second gas from the liquid carrier.

5. The system of claim 1, wherein the partition comprises a liquid permeable diaphragm.

6. The system of claim 5, wherein the liquid permeable diaphragm is non gas permeable.

7. The system of claim 5, wherein the liquid permeable diaphragm comprises a porous material comprising natural or synthetic asbestos, polysulfone, polyethersulfone, polyphenyleneoxide, polyphenylenesulfide, polyolefine, polystyrene, fluorpolymer and combinations thereof.

8. The system of claim 1, wherein the partition comprises a solid partition having an opening proximate a bottom portion of the gas-liquid separator to facilitate the liquid communication between the first and second chambers of the gas-liquid separator.

9. A gas-liquid separator, comprising:

a first chamber configured to receive a liquid carrier including a first gas therein and to separate the first gas from the liquid carrier;

a second chamber configured to receive the liquid carrier including a second gas therein and to separate the second gas from the liquid carrier; and a partition disposed between the first and second chambers to provide liquid communication between the first and second chambers.

10. The gas-liquid separator of claim 9, wherein the partition comprises a liquid permeable diaphragm.

11. The gas-liquid separator of claim 9, wherein the partition comprises a solid partition having an opening proximate a bottom of the gas-liquid separator to facilitate the liquid communication between the first and second chambers of the gas-liquid separator.

12. The gas-liquid separator of claim 9, further comprising:

a first inlet to supply the liquid carrier including the first gas to the first chamber; and a second inlet to supply the liquid carrier including the second gas to the second chamber.

13. The gas-liquid separator of claim 9, further comprising first and second outlets for releasing the first and second gases from the first and second chambers.

14. The gas-liquid separator of claim 9, further comprising a single liquid outlet configured to collect the liquid carrier from the first and second chambers.

15. A gas-liquid separator, comprising:

a first chamber configured to separate hydrogen and an electrolyte from a hydrogen-electrolyte mixture received from an electrolyzer;

a second chamber configured to separate oxygen and the electrolyte from a oxygen-electrolyte mixture received from the electrolyzer; and a liquid permeable diaphragm disposed between the first and second chambers, wherein the liquid permeable diaphragm is configured to provide a liquid communication between the first and second chambers to maintain a hydraulic equilibrium of the electrolyte within the first and second chambers.

16. The gas-liquid separator of claim 15, wherein the first chamber further comprises an inlet for receiving the hydrogen-electrolyte mixture and an outlet for releasing the hydrogen separated from the hydrogen-electrolyte mixture.

17. The gas-liquid separator of claim 15, wherein the second chamber further comprises an inlet for receiving the oxygen-electrolyte mixture and an outlet for releasing the oxygen separated from the oxygen-electrolyte mixture.

18. The gas-liquid separator of claim 15, further comprising an electrolyte outlet configured to collect the electrolyte from the first and second chambers and to recycle the collected electrolyte to the electrolyzer.

19. The gas-liquid separator of claim 15, further comprising a nitrogen purge inlet coupled to each of the first and second chambers to facilitate nitrogen purge in the first and second chambers during a start-up, or a shut down condition of the electrolyzer.

20. The gas-liquid separator of claim 15, wherein each of the first and second chambers comprises a coalescer device to facilitate gas-liquid separation in the first and second chambers.

21. The gas-liquid separator of claim 20, wherein the coalescer device comprises a baffle, or a screen.

22. The gas-liquid separator of claim 20, wherein the coalescer device is disposed above a level of electrolyte in each of the first and second chambers.

23. The gas-liquid separator of claim 15, wherein a pore size of pores of the liquid permeable diaphragm is selected to substantially prevent gas diffusion between the first and second chambers.

24. A gas-liquid separator, comprising:

a first chamber configured to separate hydrogen and an electrolyte from a hydrogen-electrolyte mixture received from an electrolyzer;

a second chamber configured to separate oxygen and the electrolyte from a oxygen-electrolyte mixture received from the electrolyzer; and a solid partition disposed between the first and second chambers, wherein the solid partition includes an opening proximate a bottom portion of the first and second chambers to facilitate a liquid communication between the first and second chambers.

25. The gas-liquid separator of claim 24, wherein the first chamber further comprises an inlet for receiving the hydrogen-electrolyte mixture and an outlet for releasing the hydrogen separated from the hydrogen-electrolyte mixture.

26. The gas-liquid separator of claim 24, wherein the second chamber further comprises an inlet for receiving the oxygen-electrolyte mixture and an outlet for releasing the oxygen separated from the oxygen-electrolyte mixture.

27. The gas-liquid separator of claim 24, further comprising an electrolyte outlet configured to collect the electrolyte from the first and second chambers and to recycle the collected electrolyte to the electrolyzer.

28. The gas-liquid separator of claim 24, further comprising a nitrogen purge inlet coupled to each of the first and second chambers to facilitate nitrogen purge in the first and second chambers during a start-up, or a shut down condition of the electrolyzer.

29. The gas-liquid separator of claim 24, wherein each of the first and second chambers comprises a coalescer device configured to facilitate bubble coalescence and gas-liquid separation in the first and second chambers.

30. The gas-liquid separator of claim 29, wherein the coalescer device comprises a baffle, or a screen.

31. The gas-liquid separator of claim 29, wherein the coalescer device is disposed above a level of electrolyte in each of the first and second chambers.

32. A method of separating hydrogen and oxygen from an electrolyte in an electrolyzer, comprising:

supplying a hydrogen-electrolyte mixture from the electrolyzer to a first chamber of a gas-liquid separator;

supplying an oxygen-electrolyte mixture from the electrolyzer to a second chamber of a gas-liquid separator;

separating hydrogen and the electrolyte from the hydrogen-electrolyte mixture via the first chamber of a gas-liquid separator;

separating oxygen and the electrolyte from the oxygen-electrolyte mixture via the second chamber of the gas-liquid separator;

regulating a level of the electrolyte in the first and second chambers by maintaining a liquid communication between the first and second chambers of the gas-liquid separator; and releasing the separated hydrogen and oxygen from the first and second chambers of the gas-liquid separator.

33. The method of claim 32, further comprising combining the electrolyte from the hydrogen-electrolyte mixture and the electrolyte from the oxygen-electrolyte mixture into a single stream at an outlet.

34. The system of claim 1, further comprising a liquid outlet configured to collect the liquid carrier from the first chamber and the second chamber.

* * * * *

UNITED STATES PATENT AND TRADEMARK OFFICE

CERTIFICATE OF CORRECTION

PATENT NO. : 7,559,978 B2
APPLICATION NO. : 11/229984
DATED : July 14, 2009
INVENTOR(S) : Soloveichik et al.

It is certified that error appears in the above-identified patent and that said Letters Patent is hereby corrected as shown below:

On the Title Page, in item (75), under "Inventors", in Column 1, Line 2, delete "Albany, NY" and insert -- Long Beach, CA --, therefor.

On the Title Page, in item (74), under "Attorney, Agent, or Firm", in Column 2, Line 1, delete "Amus" and insert -- Asmus --, therefor.

In Column 5, Line 15, delete "fluorpolymer" and insert -- fluoropolymer --, therefor.

In Column 8, Line 5, in Claim 7, delete "fluorpolymer" and insert -- fluoropolymer --, therefor.

Signed and Sealed this

Twenty-third Day of November, 2010

David J. Kappos

David J. Kappos
*Director of the United States Patent and Trademark Office*